US009997869B2

(12) United States Patent
Zhang

(10) Patent No.: US 9,997,869 B2
(45) Date of Patent: Jun. 12, 2018

(54) ELECTRICAL CONNECTOR HAVING AN OUTER SHIELDING SHELL INTEGRAL WITH AN INTERMEDIATE METAL PLATE

(71) Applicant: FOXCONN INTERCONNECT TECHNOLOGY LIMITED, Grand Cayman (KY)

(72) Inventor: Jian-Li Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/408,779

(22) Filed: Jan. 18, 2017

(65) Prior Publication Data

US 2017/0207581 A1 Jul. 20, 2017

(30) Foreign Application Priority Data

Jan. 18, 2016 (CN) ..... 2016 1 0030283

(51) Int. Cl.

| | |
|---|---|
| ***H01R 13/648*** | (2006.01) |
| ***H01R 13/6585*** | (2011.01) |
| ***H01R 24/60*** | (2011.01) |
| ***H01R 13/52*** | (2006.01) |
| *H01R 107/00* | (2006.01) |
| *H01R 13/405* | (2006.01) |

(52) U.S. Cl.

CPC ..... *H01R 13/6585* (2013.01); *H01R 13/5202* (2013.01); *H01R 24/60* (2013.01); *H01R 13/405* (2013.01); *H01R 2107/00* (2013.01)

(58) Field of Classification Search

CPC . H01L 23/4006; F21V 29/004; H01R 23/688; H01R 13/65802; H01R 23/6873

USPC ..... 439/485, 487, 607.07–607.11, 607.28, 439/607.35, 607.4

See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,808,029 | B2 * | 8/2014 | Castillo | H01R 13/6585 439/607.05 |

(Continued)

FOREIGN PATENT DOCUMENTS

| | | |
|---|---|---|
| CN | 204118373 | 1/2015 |
| CN | 204167590 | 2/2015 |

(Continued)

*Primary Examiner* — Thanh Tam Le

(74) *Attorney, Agent, or Firm* — Wei Te Chung; Ming Chieh Chang

(57) ABSTRACT

An electrical connector includes: an insulative housing including a base and a tongue; an upper and lower rows of contacts secured in the insulative housing and exposed to the tongue; a shielding shell enclosing the insulative housing; and a metal plate situated between the upper row of contacts and the lower rows of contacts; wherein the shielding shell is integrally formed with the metal plate. A related method of making such an electrical connector includes the steps of: inserting a first and second terminal modules into a first and second receiving spaces of a shielding shell, respectively, from a rear of the shielding shell; and insert molding the first and second terminal modules with a planar portion of a metal plate integral with the shielding shell.

10 Claims, 11 Drawing Sheets

(56) References Cited

U.S. PATENT DOCUMENTS

| | | | | |
|---|---|---|---|---|
| 9,022,800 | B2 * | 5/2015 | Yang | H01R 13/6581 439/487 |
| 9,088,092 | B2 | 7/2015 | Kuo | |
| 9,281,643 | B1 * | 3/2016 | Tseng | H01R 13/518 |
| 9,444,177 | B2 | 9/2016 | Tsai et al. | |
| 9,466,924 | B2 * | 10/2016 | Lin | H01R 13/6585 |
| 9,525,241 | B1 * | 12/2016 | Su | H01R 13/6581 |
| 9,525,243 | B1 * | 12/2016 | Yuan | H01R 13/6585 |
| 2015/0244099 | A1 | 8/2015 | Lee | |
| 2016/0104957 | A1 | 4/2016 | Kim et al. | |
| 2016/0111821 | A1 | 4/2016 | Lan et al. | |

FOREIGN PATENT DOCUMENTS

| | | | |
|---|---|---|---|
| CN | 105226452 | A | 1/2016 |
| TW | M511697 | U | 11/2015 |
| TW | M514136 | U | 12/2015 |
| WO | 2015181629 | A2 | 12/2015 |

* cited by examiner

ELECTRICAL CONNECTOR HAVING AN OUTER SHIELDING SHELL INTEGRAL WITH AN INTERMEDIATE METAL PLATE

BACKGROUND OF THE INVENTION

1. Field of the Invention

The present invention relates to a waterproof electrical connector having an outer shielding shell and an intermediate metal plate.

2. Description of Related Arts

China Patent No. 204118373, issued on Jan. 21, 2015, discloses an electrical connector including an insulative housing, a shielding shell enclosing the inner insulative housing, and a rear sealing member or potting resin.

U.S. Patent Application Publication No. 2015/0244099, published on Aug. 27, 2015, discloses a waterproof connection module including a shell that may be manufactured using die casting to improve waterproof performance.

U.S. Patent Application Publication No. 2016/0104957, published on Apr. 14, 2016, discloses a waterproof connector assembly including a housing in a form of a seamless tube to increase waterproof efficient. The housing may be formed in an integral type by deep drawing.

SUMMARY OF THE INVENTION

An electrical connector comprises: an insulative housing including a base and a tongue; an upper and lower rows of contacts secured in the insulative housing and exposed to the tongue; a shielding shell enclosing the insulative housing; and a metal plate situated between the upper row of contacts and the lower rows of contacts; wherein the shielding shell is integrally formed with the metal plate. A method of making such electrical connector comprises the steps of: inserting a first and second terminal modules into a first and second receiving spaces of a shielding shell, respectively, from a rear of the shielding shell; and insert molding the first and second terminal modules with a planar portion of a metal plate integral with the shielding shell.

DETAILED DESCRIPTION OF THE PREFERRED EMBODIMENT

Figure 1:
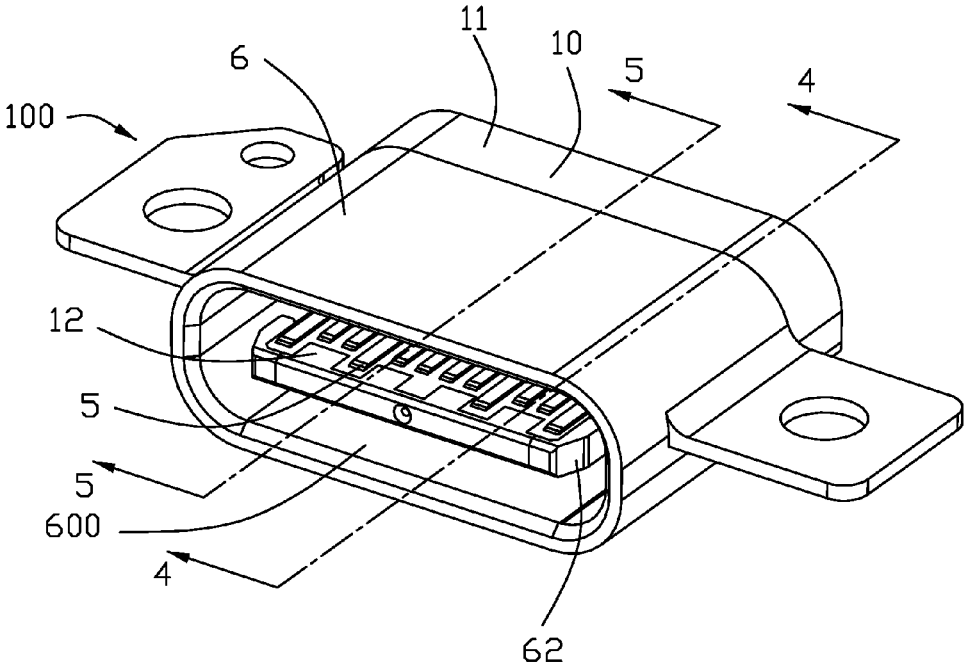
FIG. 1 is a perspective view of an electrical connector in accordance with the present invention.
Figure 2:
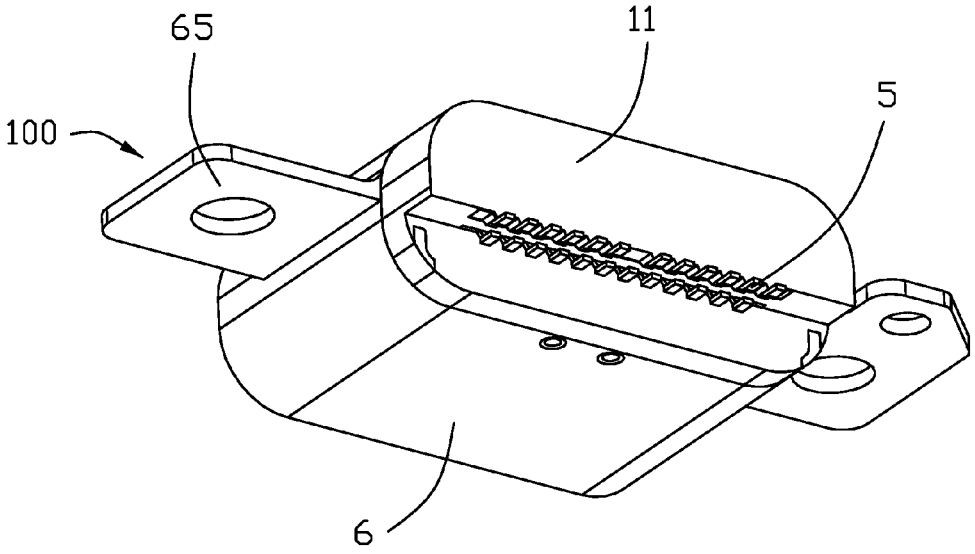
FIG. 2 is another perspective view of the electrical connector.
Figure 3:
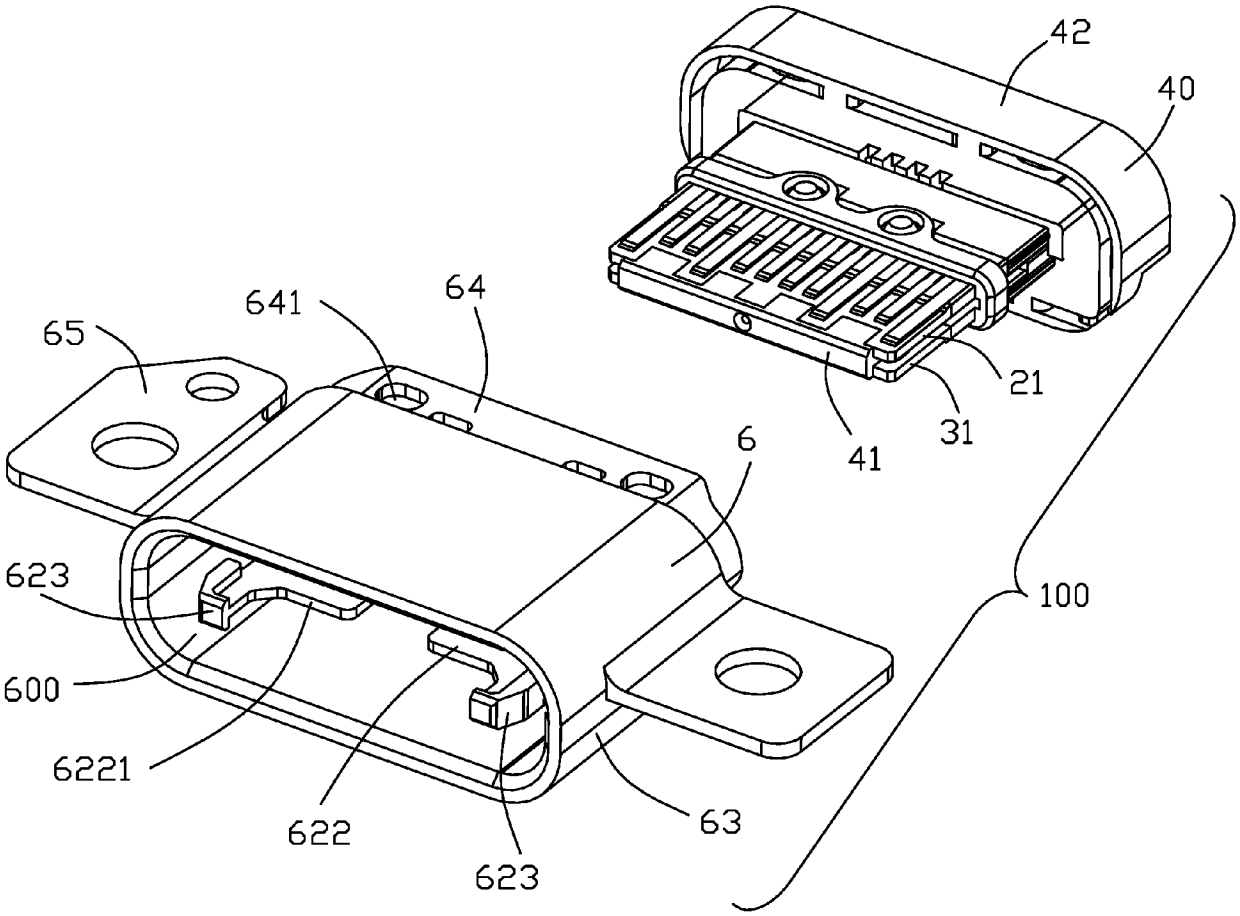
FIG. 3 is an exploded view of the electrical connector.
Figure 4:
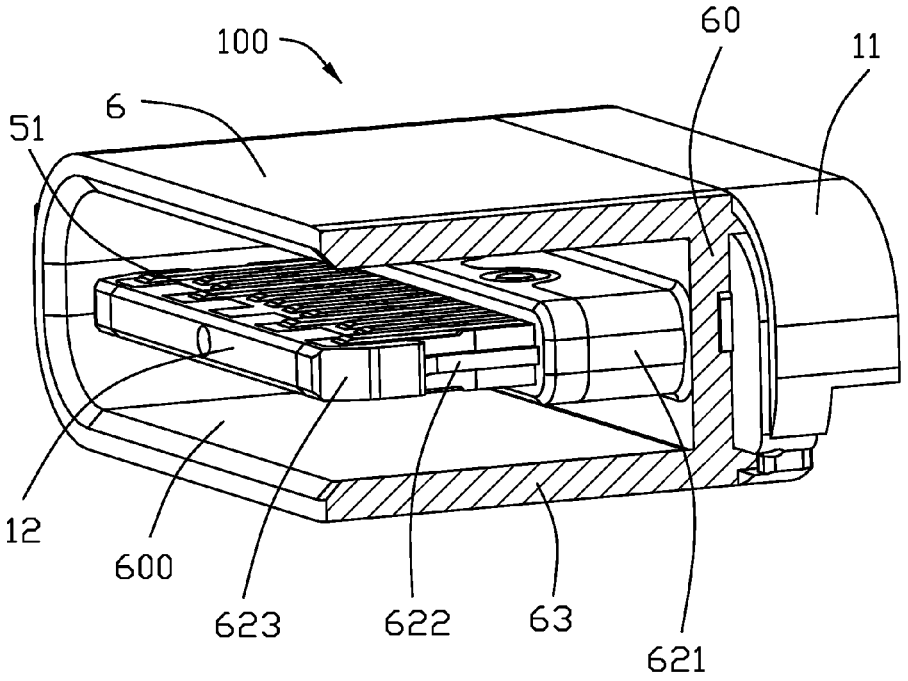
FIG. 4 is a cross-sectional view of the electrical connector taken along line 4-4 in FIG. 1.

Referring to FIGS. 1 to 11, an electrical connector 100 comprises an insulative housing 10, an upper and lower rows of contacts 5 secured in the insulative housing, a shielding shell 6 enclosing the insulative housing, and a metal plate 62 situated between the upper and lower rows of contacts.

The insulative housing 10 includes a base 11 and a tongue 12. Specifically, the insulative housing 10 includes an upper body 20, a lower body 30, and a molding member 40.

The upper body 20 has a first base part 22 and a first tongue part 21 and the lower body 30 has a second base part 32 and a second tongue part 31. The first tongue part 21 includes a front portion 211 and a separate rear portion 212. The second tongue part 31 also includes a front portion 311 and a separate rear portion 312. The molding member 40 includes a final molding part 41 and a separate sealing member 42. The first tongue part 21, the second tongue part 31, and the final molding part 41 together define the tongue 12 of the insulative housing 10.

Figure 5:
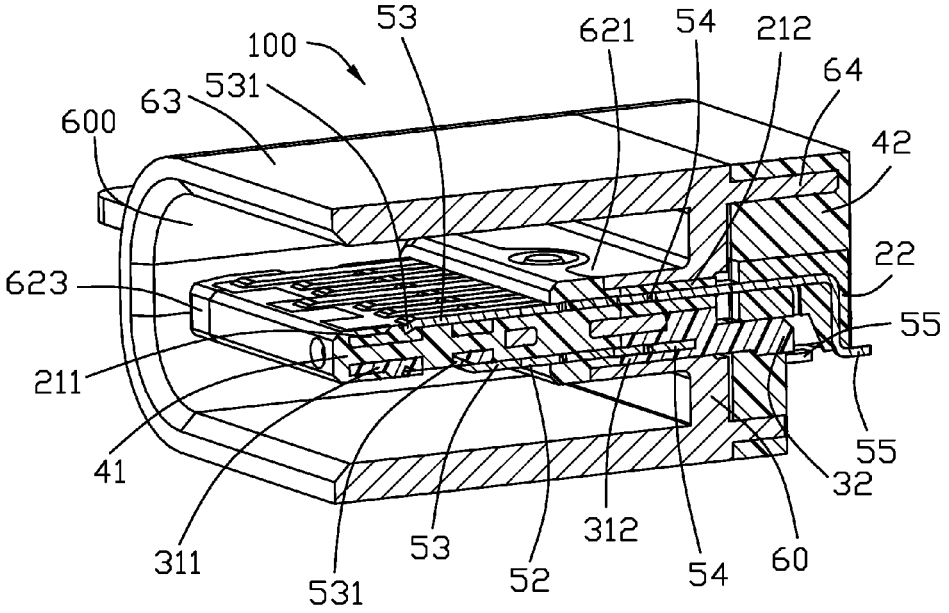
FIG. 5 is a cross-sectional view of the electrical connector taken along line 5-5 in FIG. 1.
Figure 6:
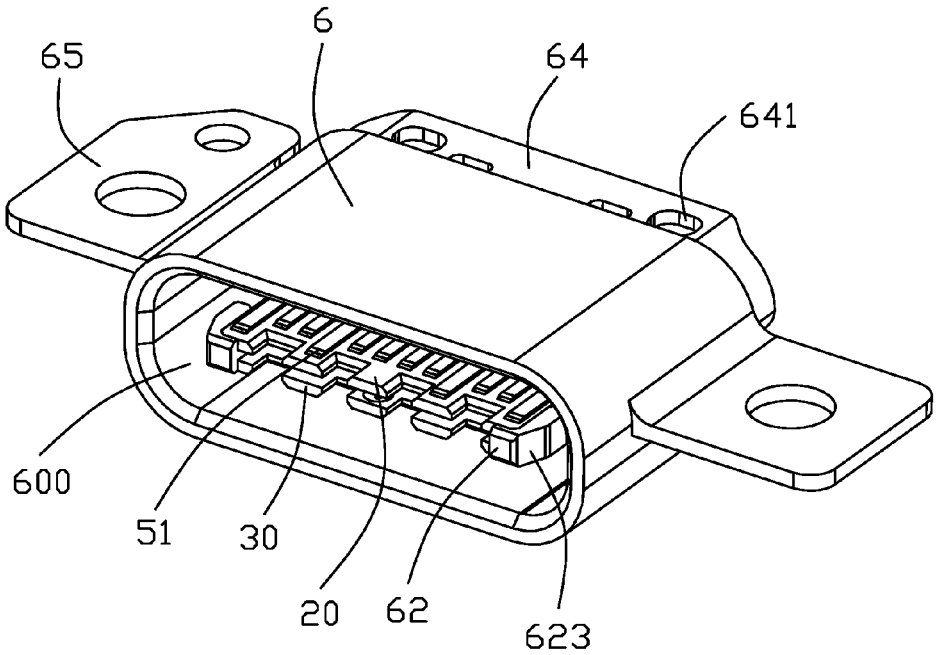
FIG. 6 is a view similar to FIG. 1, omitting a final insert molding.
Figure 7:
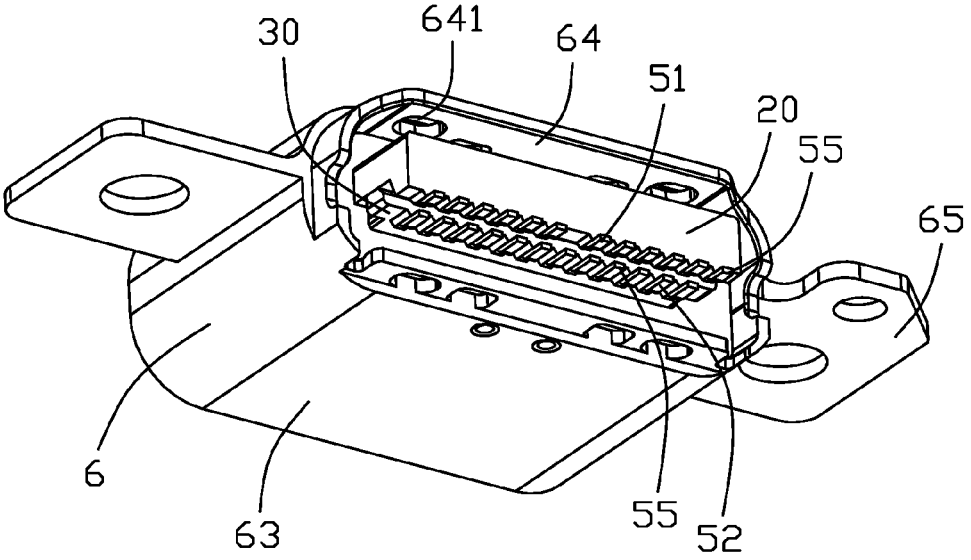
FIG. 7 is a view similar to FIG. 2, omitting a final insert molding.
Figure 8:
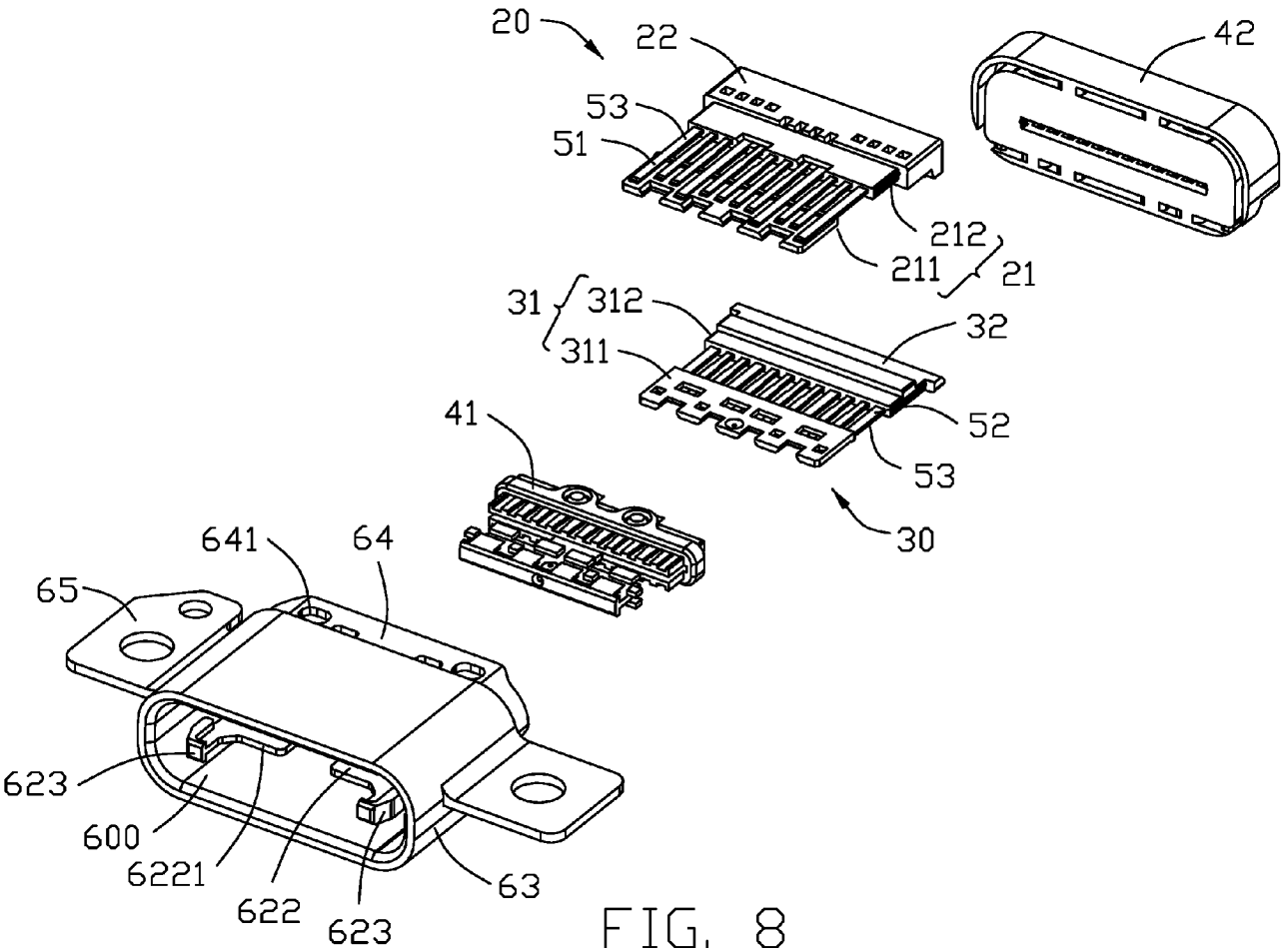
FIG. 8 is a further exploded view of the electrical connector in FIG. 3.
Figure 9:
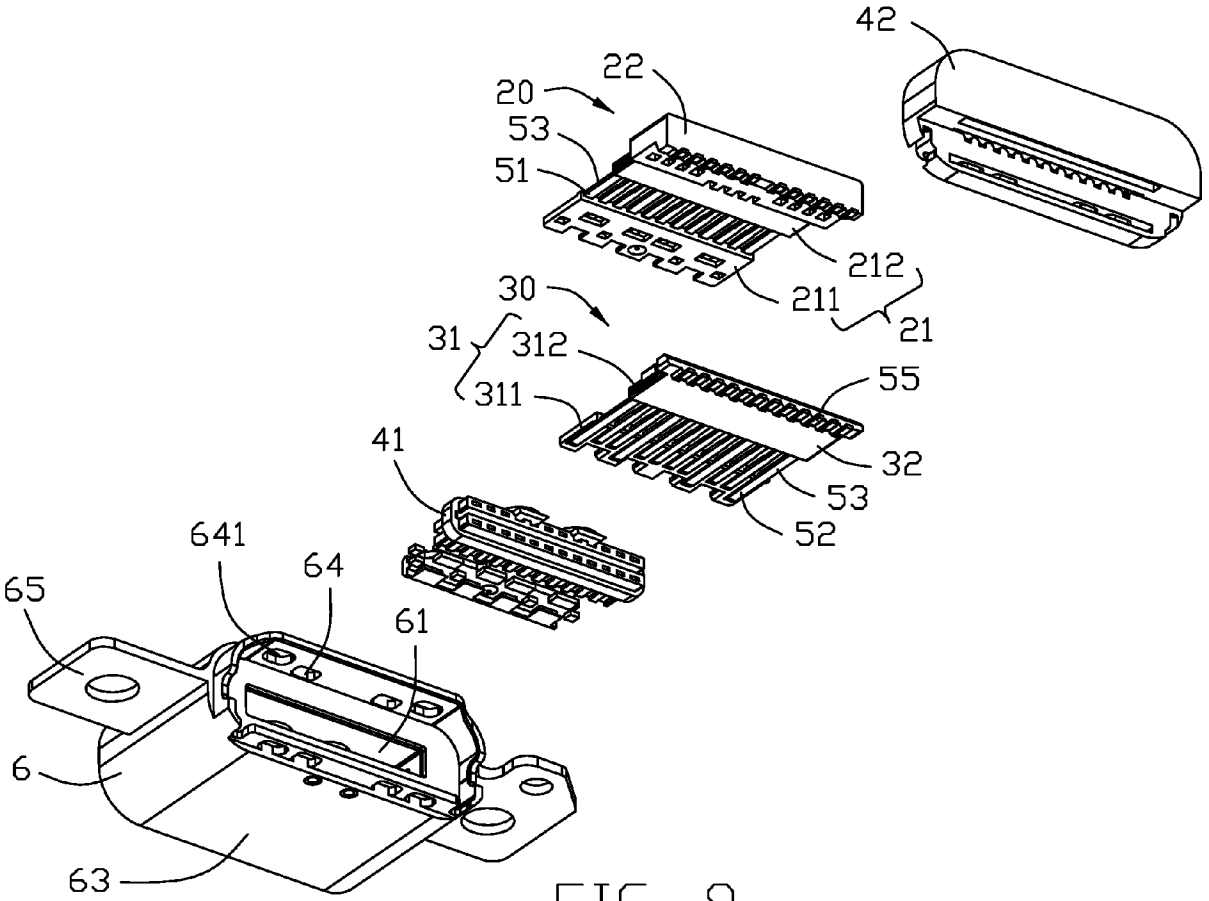
FIG. 9 is a view similar to FIG. 8 but from a different perspective.
Figure 10:
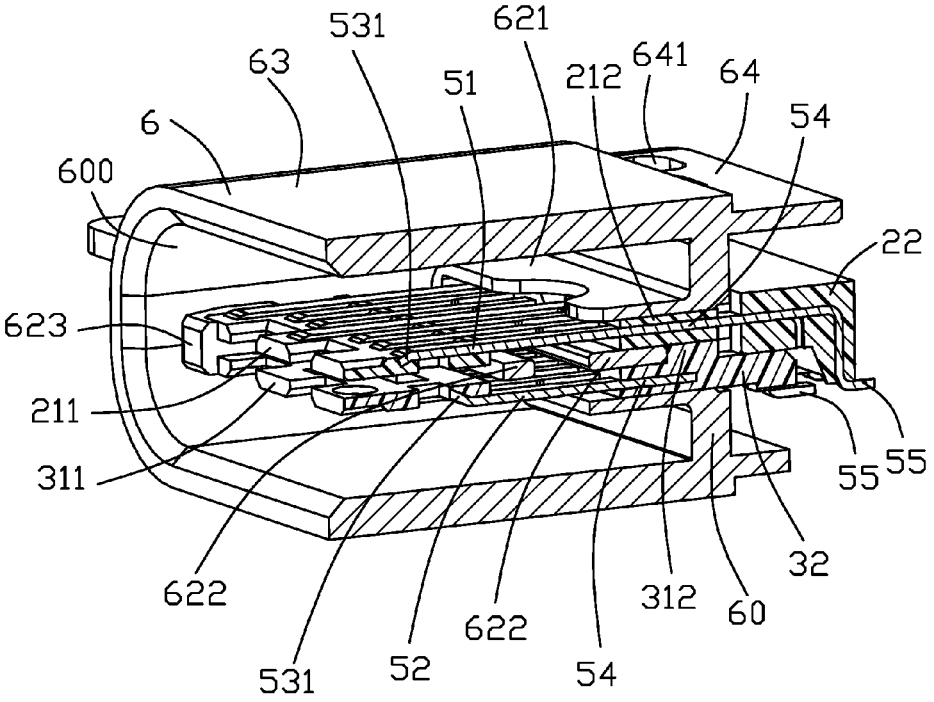
FIG. 10 is a cross-sectional view of the electrical connector taken along line 5-5 in FIG. 1, omitting a final insert molding.

The upper row of contacts 51 and the lower row of contacts 52 are so arranged that both orientations of an inserted mating connector are acceptable, as is well known in this art. Each of the upper and lower rows of contacts 5 has securing portion 54, a contact portion 53 exposed to the tongue 12, and a tail 55. The contact portion 53 may further include a front embedded portion 531 (FIG. 5).

Figure 11:
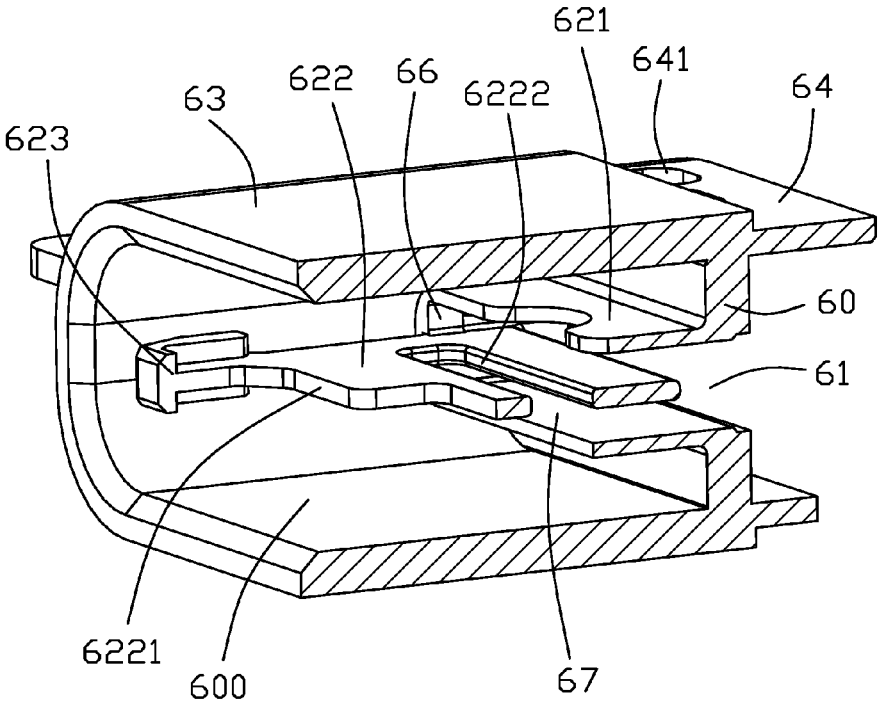
FIG. 11 is a view similar to FIG. 10 but showing only a shielding shell of the electrical connector.

As best seen in FIG. 11, the shielding shell 6, to be mounted to a printed circuit board, encloses the insulative housing 10 and includes a base 60, an outer sleeve 63, and an inner sleeve 621. The shielding shell 6 may include a rear extension 64 extending from the base 60. The extension 64 has one or more holes 641. A stepped structure is formed between the outer sleeve 63 and the extension 64. The inner sleeve 621 defines an opening 61 through the base 60. A pair of wings 65 extend from the outer sleeve 63.

The shielding shell 6 and the metal plate 62 are formed as a uni-body by suitable metalworking processes, such as sintering, casting, etc. The metal plate 62 includes a planar portion 622 and a pair of corner protrusions 623. The planar portion 622 connects to the interior wall of the inner sleeve 621 and extends forward. The planar portion 622 has a notch 6221 and one or more holes 6222. The planar portion 622, the inner sleeve 621, and the corner protrusions 623 together define a first receiving space 66 and a second receiving space 67. The first and second receiving spaces 66 and 67 are in fluid communication with exterior through the opening 61. A mating cavity 600 is formed in the shielding shell 6 in front of the base 60.

In making of the electrical connector 100, firstly, a first terminal module constituted by the upper body 20 insert molded with the upper row of contacts 51 and a second terminal module constituted by the lower body 30 insert molded with the lower row of contacts 52 are inserted, from a rear of the shielding shell 6 through the opening 61, into the first receiving space 66 and the second receiving space 67, respectively. Then, an insert molding process is performed which essentially insert molds the final molding part 41 to bind the first and second terminal modules with the planar portion 622 of the metal plate 6. Separately or simultaneous with the insert molding process, the sealing member 42 may be formed at the rear of the shielding shell 6.

What is claimed is:

1. An electrical connector comprising:

an insulative housing including a base and a tongue;

an upper and lower rows of contacts secured in the insulative housing and exposed to the tongue;

a shielding shell enclosing the insulative housing; and a metal plate situated between the upper row of contacts and the lower rows of contacts; wherein the shielding shell is integrally formed with the metal plate as a uni-body;

the shielding shell includes a rear extension extending from the base; and the insulative housing includes a sealing member separated from the base, the sealing member surrounding the rear extension of the shielding shell and the base of the insulative housing.

2. The electrical connector as claimed in claim 1, wherein the shielding shell includes a base, an outer sleeve, and an inner sleeve, and the metal shell is connected to the inner sleeve.

3. The electrical connector as claimed in claim 1, wherein the metal plate includes a planar portion and a pair of corner protrusions.

4. The electrical connector as claimed in claim 1, wherein the base of the insulative housing is received in the inner sleeve of the shielding shell.

5. An electrical connector comprising:

an insulative housing including a base and a tongue portion extending forwardly from the base in a front-to-back direction, the tongue portion defining opposite first and second surfaces in a vertical direction perpendicular to said front-to-back direction;

a plurality of contacts disposed in the housing with corresponding contacting sections exposed upon at least one of said first and second surfaces;

a metallic shielding shell assembled upon and enclosing the housing to define a mating cavity;

a metallic shielding plate including a planar portion embedded within the tongue portion between said first and second surfaces in the vertical direction; and a waterproof sealing member applied upon an exterior surface and an interior surface of the shielding shell, rear portions of the two terminal modules, and a rear face of the base of the shielding shell; wherein said shielding plate is unitarily formed with the shielding shell;

said shielding shell includes a base extending in the vertical direction behind the mating cavity, and an opening is formed in the base through which at least one terminal module including corresponding contacts is inserted into a corresponding receiving space formed in the shielding plate;

there are two terminal modules unitarily formed with corresponding contacts and respectively positioned upon two opposite surfaces of the planar portion of the shielding plate in the vertical direction; and said two terminal modules are separated from each other in the vertical direction by an insulative final molding part which is insert-molded upon the terminal modules and the planar portion of the shielding plate.

6. The electrical connector as claimed in claim 5, wherein said shielding plate further includes an inner sleeve surrounding the planar portion, and the receiving space is formed between the inner sleeve and the planar portion in the vertical direction.

7. The electrical connector as claimed in claim 5, further including an insulative final molding part insert-molded upon the terminal module and the planar portion of the shielding plate to secure therebetween and finalize a whole configuration of the tongue portion.

8. The electrical connector as claimed in claim 5, wherein rear portions of said two terminal modules are directly stacked with each other in the vertical direction.

9. The electrical connector as claimed in claim 5, wherein each of said terminal modules has a region without corresponding insulative body to fully transversely expose the corresponding contacts, and said region is successively filled with the final molding part.

10. The electrical connector as claimed in claim 5, wherein said shielding shell and said shielding plate are unitarily formed by a die-casting process to have different thicknesses.

* * * * *